United States Patent [19]

Booth et al.

[11] 4,132,580

[45] Jan. 2, 1979

[54] METHOD OF MAKING CARD CLOTHING WITH A REINFORCING BACK

[75] Inventors: Graham R. Booth, Brighouse; John S. Smith, Rawdon, near. Leeds; Malcolm Clayton, Huddersfield, all of England

[73] Assignee: The English Card Clothing Company Limited, Huddersfield, England

[21] Appl. No.: 704,745

[22] Filed: Jul. 12, 1976

Related U.S. Application Data

[63] Continuation of Ser. No. 510,790, Sep. 30, 1974, abandoned.

[30] Foreign Application Priority Data

Oct. 4, 1973 [GB] United Kingdom ..... 46295/73

[51] Int. Cl.[2] ..... B29G 7/00; B29D 3/02

[52] U.S. Cl. ..... 156/193; 156/305; 264/159; 264/255; 264/257; 264/261; 264/263; 264/137; 264/138

[58] Field of Search ..... 156/184, 189, 196, 200, 156/201, 211, 212, 213, 216, 257, 259, 252, 173, 190, 191, 193, 199, 242, 250, 305; 264/248, 157, 154, 156, 285, 259, 267, 339, 261-263, 271, 228, 257, 243, 250, 255; 144/254, 255, 270, 271; 19/99, 102, 103, 104, 113, 114

[56] References Cited

U.S. PATENT DOCUMENTS

| | | | |
|---|---|---|---|
| 2,653,887 | 9/1953 | Slayter | 156/191 |
| 2,679,468 | 5/1954 | Pitman | 156/252 |
| 3,215,763 | 11/1965 | Buerger | 156/212 |
| 3,536,800 | 10/1970 | Hubbard | 264/255 |
| 3,825,459 | 7/1970 | Taylor | 264/177 R |

FOREIGN PATENT DOCUMENTS

| | | |
|---|---|---|
| 35137 | 10/1925 | Denmark. |
| 400971 | 11/1933 | United Kingdom. |
| 1287311 | 8/1972 | United Kingdom. |

*Primary Examiner*—Willard E. Hoag
*Attorney, Agent, or Firm*—Norris & Bateman

[57] ABSTRACT

An arcuate card-clothed element is manufactured by combining a deformable sustaining element which may for example be a slotted stiffener or a layer of fibre glass with a flexible toothed foundation while the sustaining element is in a deformable condition and shaped to the desired arcuate contour of the card-clothed element, and introducing a hardenable bonding medium such as a resin to hold the foundation in the shape of the sustaining element and convert the sustaining element to a substantially rigid state. The card-clothed element may be made in individual sectors, or may comprise sectors cut from a cylindrical assembly built on a former.

6 Claims, 6 Drawing Figures

METHOD OF MAKING CARD CLOTHING WITH A REINFORCING BACK

Figure 1:
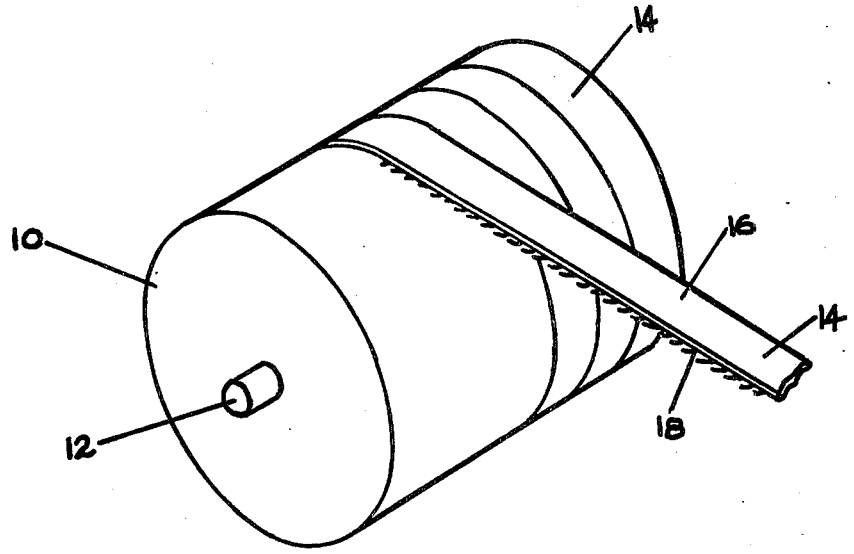

This is a continuation of Ser. No. 510,290 filed Sept. 30, 1974, and now abandoned.

In a conventional carding machine, the card-clothing is formed into a desired operational configuration by its application to parts of the machine. Thus, in the case of a woollen type carding machine all the card-clothing is formed into cylindrical configurations by applying it to the swifts, worker and stripper rollers, doffers, fancies, lickerin roller and the like. In the case of a moving-flat carding machine, the card-clothing which is secured to the flats is in the form of strips (or tops) which adopt the flat configuration dictated by the flats themselves.

It is the object of the present invention to provide a method of forming the card-clothing into a desired (operational) configuration the method being independent of the parts of the carding machine itself. Although the invention in its broadest aspect is capable of being used to produce card-clothing elements for use on any part of a carding machine, it is particularly beneficial in the production of a stationary arcuate card-clothed element of the kind which is fitted closely adjacent to a card-clothed cylinder, the arcuate element having its card-clothing on the concave side (see, for example, British Pat. Nos. 400,971 and 1,287,311). The invention also aims at making available card-clothed elements for use in a carding machine, in a form in which they are readily fitted on to the machine, and replacement of the elements is also facilitated.

According to a first aspect of the invention a method of manufacturing a card-clothed arcuate element comprises winding card-clothed strips (as herein defined) on to a cylindrical former with the teeth projecting on the concave inside face of the strips and affixing a sustaining element to the convex outside face of the strips of card-clothing whilst the card-clothing is on the former, and then severing the card-clothing along lines axial of the former on each side of the sustaining element.

It will be appreciated that this aspect of the invention can be carried out simply by wrapping card-clothed fillet or metallic card-clothing around the former and then affixing thereto — as by bonding — a pre-formed sustaining element.

The sustaining element may be made as a rigid member, for example by moulding plastics material or die-casting in metal, or by steam setting a timber sheet. Alternatively, the sustaining element may be made of inherently flexible material (e.g., timber or thin metal sheet) which is bent to the required configuration and secured to one or more rigid supports which hold the sustaining element in the required configuration.

According to a second aspect of the invention a method of manufacturing a card-clothed element comprises affixing a sustaining element whilst it is in a deformable condition to the card-clothing, and causing the sustaining element to change into a substantially rigid condition such that it holds the card-clothing in a desired operation configuration. This method provides a way of carrying out the first aspect of the invention using a preformed sustaining element.

Preferably the card-clothing is first located in the desired operational configuration and then the sustaining element is affixed to the card-clothing.

The sustaining element in either aspect of the invention may include or comprise a setting material which is affixed to the card-clothing in a fluid form, but which is then caused to set into a sufficiently rigid form to sustain the desired operational configuration of the card-clothing. Thus, in a very simple way of carrying out the invention the sustaining element could take the form of a layer of resin which is applied to the card-clothing in fluid form and then caused to set. Preferably, however, the sustaining element takes the form of a sheet of deformable material to which resin in fluid is applied in such a way that as the resin sets, the sheet of deformable material becomes rigid.

In one method of carrying out the invention a sheet of flexible timber is affixed to the card-clothing by a bonding process and resin is applied to the timber to cause the timber to become rigid when the resin sets. If the timber has a flexibility such that it can be deformed as required, the resin can be simply impregnated into the timber, but in a preferred method, the timber is inherently quite rigid but is made flexible by a series of saw-cuts or grooves, which open or close when the timber is bent to the desired configuration, the opened-up or closed saw-cuts or grooves being at least partially filled with resin in fluid form, which is then allowed to set to prevent closure or opening (as the case may be) of the saw-cuts or grooves, whereby the timber retains its bent configuration.

If the card-clothed elements are required to have an arcuate form, with the teeth on the concave side, then as in the first aspect of the invention the card-clothing can be given the desired operational configuration before application of the sustaining element, by locating the card-clothing on the convex surface of a curved former with the teeth of the card-clothing on the inside.

The second aspect of the invention can be used to provide a method of manufacturing an arcuate card-clothed element with the teeth on the concave side, in which case the method comprises locating card-clothing on the convex surface of a curved former with the teeth of the card-clothing on the inside, whereby the card-clothing assumes the required arcuate form as dictated by the former; applying a sustaining layer which includes a setting material in fluid form to the convex side of the card-clothing, and causing the setting material to set whereby the sustaining layer becomes bonded to the card-clothing and adopts a sufficiently rigid form to sustain adequately the arcuate formation of the card-clothing.

The card-clothing preferably comprises a series of strips (as herein defined) and those strips are preferably laid side-by-side on a former. It is to be understood however, that in some instances, card-clothing in wide sheet form may be employed.

In this specification, the following expressions have special definitions ascribed to them:

1. "Card-clothed strips" includes strips of flexible wire card-clothing in which the teeth project from a flexible foundation, the foundation being in the form of an elongated strip usually referred to as "fillet" and it also includes metallic-wire type card-clothing in which a series of teeth are formed saw-tooth fashion along the length of a single wire.
2. "In fluid form" includes material which is in a true liquid state and material which is in a semi-liquid paste-like or plastic state.
3. "Bonding" includes both a process in which a fluid setting material is inherently adhesive in relation to the material to which it is applied and a process which requires the application of an adhesive.

4. "Side-by-side arrangement" means either a series of convolutions in the case of helically wound card-clothed fillet or metallic wire, or a series of parallel strips of fillet or wires secured in position separately from each other, the edges of the strips or wires lying in a direction at right angles to the axis about which the former is curved. The expression "side-by-side" does not necessarily mean that the edges of adjacent convolutions or strips are in abutting relationship.

The curvature of the convex surface of the former may be such that when the points of the teeth of the card-clothing are resting on it, the card-clothing is in the correct arcuate form as required in the finished card-clothed element. Conveniently, the former may be a cylinder, so that the card-clothing can be applied in the conventional manner, as in the application of card-clothing to a cylinder or swift, excepting that the teeth are on the inside instead of on the outside. If this method is used, then the cylinder of card-clothing must be divided by slitting longitudinally (i.e., in a direction axial of the former) to produce a series of arcuate elements.

Alternatively, the former may be a segment of a cylinder, the card-clothing being pressed on to the convex surface of the former with the teeth of the card-clothing on the inside, the sustaining layer then being applied to the outside of the card-clothing.

A suitable material for use as the setting material is glass-fibre reinforced resin of the kind which is used for a variety of structural purposes, for example, in the construction of the hulls of boats. If glass-fibre reinforced resin is used, then the reinforcement may be any of the known types, but preferably is in the form of a woven mat, which has fibres extending both laterally and longitudinally, in order to give adequate strength to the resin layer, when the latter has set. It will be understood however that other types of reinforcing could be introduced into the setting layer, for example, metal, timber, carbon-fibre or like reinforcing elements. In one preferred method, a sandwich construction is employed, consisting of a layer of glass fibres impregnated with resin, then a layer of cheap filler resin, and finally a further layer of glass fibres impregnated with a resin.

The outside of the card-clothed element may be machined after the element has adopted its rigid form, so that the element is properly shaped for reception in the carding machine. Thus, in the case of elements formed by winding on to a cylindrical surface, it is possible to turn or to grind the outside of the sustaining element on the card-clothed cylinder before slitting into the several arcuate elements. If arcuate elements are produced, whether by winding on to a cylinder former or by laying sheet card-clothing on a segmental former, the outer surface of the element can be profile machined (as by a cutting or grinding tool making longitudinal passes), to produce an arcuate part-cylindrical convex outer surface.

According to a preferred feature of the invention a carding device for use in a carding machine comprises card-clothing held in a rigid form by a sustaining element which is permanently affixed to the card-clothing. Such a carding device can be readily fitted in or removed from a carding machine, and by virtue of the rigidity imparted to it by the sustaining element, it is always in the correct shape for use and its card-clothing is not distorted by the part of the machine to which it is secured.

Figure 2:
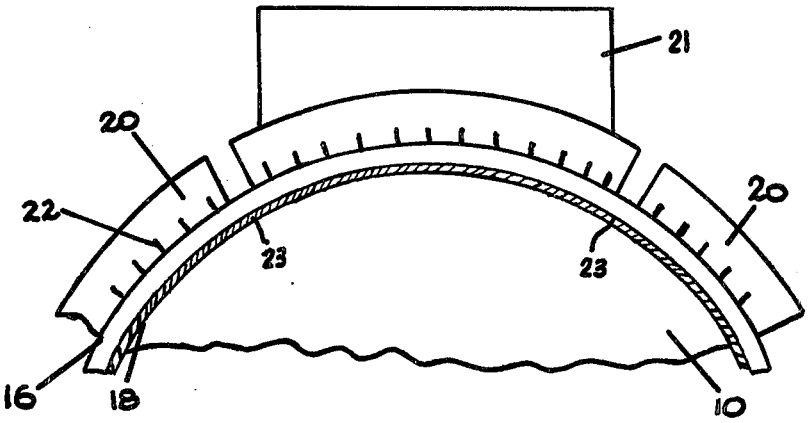
Figure 3:
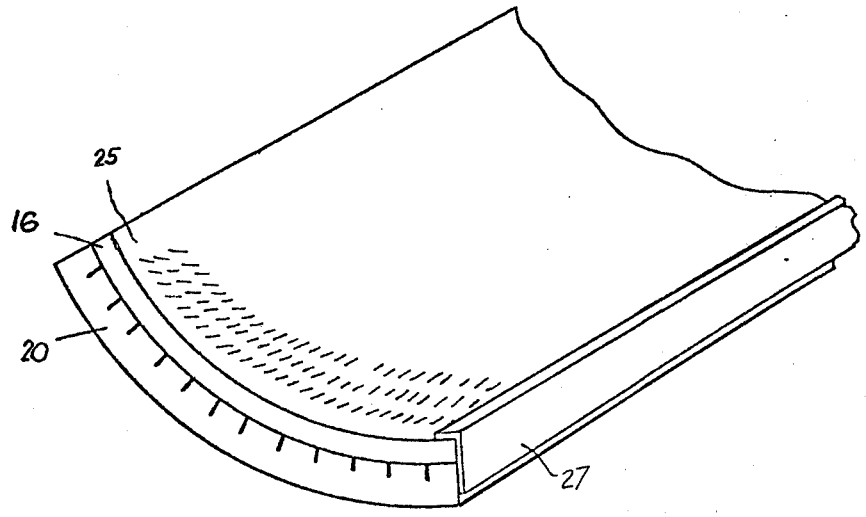
Figure 4:
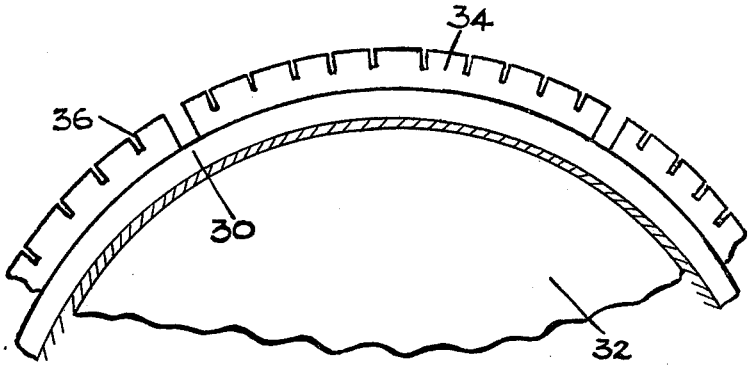
Figure 5:
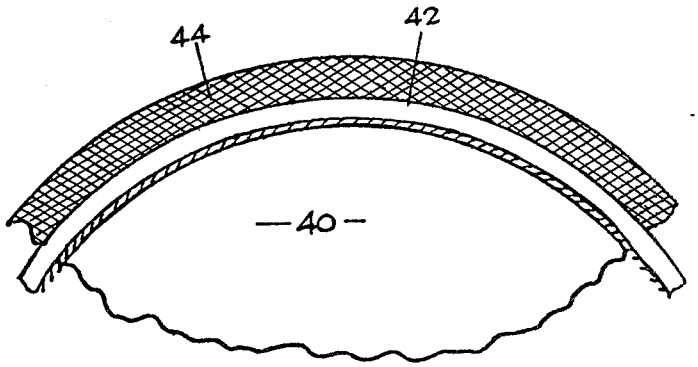
Figure 6:
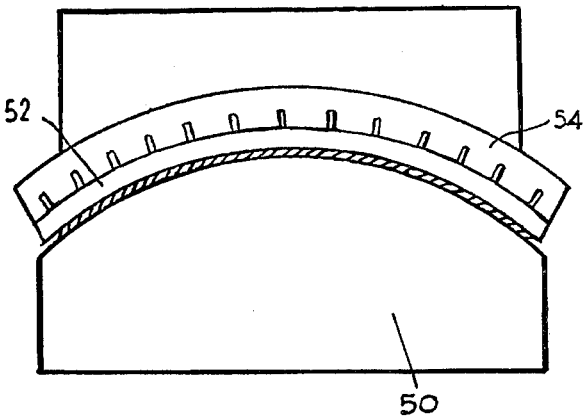

One method of manufacturing arcuate card-clothed elements and three modified methods, all in accordance with the invention, will now be described by way of examples only, with reference to the accompanying drawings, in which:

FIG. 1 is a diagram showing the application of fillet type card-clothing to a former, FIG. 2 is a cross-section through part of a former showing a stage in the formation of arcuate card-clothed elements thereon, FIG. 3 is a perspective view of a completed arcuate card-clothed element, FIG. 4 is a cross-section similar to FIG. 2, but showing a stage in an alternative method of forming arcuate card-clothed elements, FIG. 5 is a cross-section similar to FIG. 2, but showing a stage in a further alternative method of forming arcuate card-clothed elements, and FIG. 6 is a cross-section similar to FIG. 2, but showing a stage in another alternative method of forming arcuate card-clothed elements.

The card-clothed elements which are produced by this particular method are intended to be located in fixed positions closely adjacent to the periphery of a card-clothed swift or cylinder, so that they co-operate with the swift or cylinder in a carding action. There have been proposals for using such stationary arcuate card-clothed elements, and if the card-clothing is properly constructed, such elements have a high carding efficiency, and little waste is produced. Obviously however it is more difficult to produce arcuate elements, with the card-clothing on the concave side of the element, than it is to produce the conventional flats or card-clothed worker and stripper rollers.

In a proposed method of manufacturing arcuate card-clothed elements, metallic wire card-clothing is given a permanent set by passing it through a groove in a rotatable roll, and this wire is then wound on to a drum with the teeth pointing inwardly. The wire is then cut along lines axial of the drum into arcuate segments and removed from the drum as a number of separate arcuate strips which have to be assembled in side-by-side arrangement and then secured to the inside of a curved metal plate. This method is described in British Pat. No. 1,287,311. The drawbacks of this system are firstly that it is difficult to assemble and secure the metallic wire to the curved metal plates whilst maintaining an arcuate curvature of the card-clothing itself and secondly, that whenever the wire needs to be replaced, this cannot be done at the mill, but necessitates returning the metal plate to the card-clothing or machine manufacturer.

For the purpose of the present invention, a former 10 is used, which in this instance comprises a cylinder the outside diameter of which is approximately equal to the outside diameter of the swift or cylinder with which the card-clothed elements are to co-operate (measured over the points of the card-clothing on that swift or cylinder) plus twice the clearance which is required between the points of the teeth on the card-clothed swift or cylinder, and the points of the teeth on the arcuate card-clothed element. This former is provided with an axle 12, and is mounted in journal bearings (not shown), so that it can be rotated about its own longitudinal axis. The width of the former is equivalent to or greater than the width of the card-clothed cylinder or swift with which the arcuate element is required to co-operate, and it will be appreciated therefore that the former resembles an unclothed swift or cylinder.

For the purpose of the present example, it is assumed that flexible type card clothing manufactured in the form of strip or fillet is being used on the stationary arcuate element. Such card-clothing comprises a foundation 16 made up as a laminate of several layers of fabric bonded together, and teeth 18, which are produced by wire staples pressed through the foundation to produce the projecting teeth 18. The card-clothed fillet is available in the form of a coil as would normally be supplied for winding on to the periphery of a cylinder or roller.

The former 10 is rotated, and the fillet 14 is wound on to the roller in the helical manner in which card-clothing of this type is normally applied to a cylinder, excepting that the teeth 18 of the card-clothing are on the inside instead of on the outside. Eventually the entire cylindrical surface of the former is covered with the card-clothing 14, which is then secured in the conventional manner. At this stage, the exterior of the former presents a plain cylindrical surface, produced by what is normally the underside of the card-clothing foundation. In the drawings, the thickness of the card-clothing has been exaggerated for clarity.

At angularly spaced apart positions corresponding to axial divisions between a series of arcuate card-clothed elements which are being produced, the wires are withdrawn from the foundation, leaving narrow strips 23 (say 1 inch wide) of foundation without teeth, each of these strips 23 extending across the full width of the card-clothing on the former. The purpose of these toothless areas will become apparent later.

In order to produce arcuate card-clothed elements, a series of timber stiffeners 20 is applied to the exposed cylindrical surface of the card-clothing, with only narrow gaps aligned with the toothless strips 23 between the stiffeners. Only one such stiffener will be described in detail. It is cut from a sheet of wood (for example plywood ½ inch thick) the wood sheet having an area the same as that of the rear (outer) surface of the card-clothing which is to form one of the elements. In order to give the wood the necessary degree of flexibility to allow it to be bent to the contour of the card-clothing, a series of saw-cuts 22 is formed in the inside of the wood sheet, each cut extending longitudinally of the sheet (i.e., parallel to the axis of curvature of the former 10). The timber sheet is preformed to an arcuate shape. This is done by bending the sheet and fixing it — as by nailing for example, to the underside of one or more rigid timber support blocks 21. The support blocks 21 are used for mounting the arcuate element on to the mounting system (not shown) on the carding machine. It will be observed that the underside of the block 21 is of arcuate shape and hence the timber sheet 20 is pulled into a corresponding shape when it is secured thereto. The bending operation causes each of the saw-cuts 22 to partially close so that it is of Vee-shaped cross-section.

Resinous adhesive material in fluid form is spread over the concave surface of the timber sheet and the sheet is then applied to the outside, convex surface of the card-clothing 14. When the resin sets, besides securing the timber sheet 20 to the card-clothing 14 the resin also prevents the Vee-grooves 22 opening, thus assisting in holding the sheet in the bent, arcuate form.

Next, the annular layer of card-clothing with its sustaining timber elements is divided into a series of sectors, by slitting the card-clothing along longitudinal lines between the timber stiffeners 20. The slit is made midway across the width of the toothless strip 23 — the absence of teeth facilitating the slitting operation — leaving a narrow toothless margin 25 along each transverse edge of the separated card-clothed element (see FIG. 3). In this particular example, the composite layer is split into sectors about 15 inches in width, the length of each sector being equal to the width of the former 10.

When the sectors thus divided from each other, are removed from the former, each of them maintains its own arcuate shape, by virtue of the rigidity of the timber stiffener and the now cured resin. This produces the completed arcuate card-clothed element 24 shown in FIG. 3.

A strip-like metal or plastics clamping member 27 one of which is shown in FIG. 3 is then fixed to each transverse edge of the element 24, a flange of this member 27 overlying the toothless margin 25. This member serves to protect the otherwise exposed edges of the card-clothing.

It is then possible to affix such an element 24 to say a metal bracket or brackets, an arcuate metal plate or any other mounting system on a carding machine. For example, the element can be formed with holes, to receive fixing bolts or screws, or it can be stuck to a metal plate, by means of an adhesive. However, it is preferred to use a mechanical fixing means rather than an adhesive. The sustaining layer provided by the stiffener and the resin holds the card-clothing in the correct arcuate shape and the element is not easily distorted when it is being secured on the machine. Hence the card-clothing on the element is correctly positioned relatively to that on the cylinder when the element has been mounted on the machine.

As an alternative to preforming the sustaining element by securing it to the support blocks 21, the timber sheet 20 may be formed to the required arcuate shape by bending it to the curvature of the card-clothing wound on to the drum 10. In this method, the resin is applied to the inside face of the sheet 20 and into the grooves 22 whilst the sheet is flat. Then as the sheet is applied to the convex side of the card-clothing, it is bent into the arcuate form, causing the grooves 22 to close. The adhesive sets, securing the sheet 20 to the card-clothing and also causing the sheet 20 to adopt a rigid form.

At this stage, the outer face of the timber layer may be machined if required, to produce the required precise arcuate form to match the part of the carding machine to which the carding elements are to be secured. The surface may be turned, ground or profile machined.

If the element is merely to be secured to brackets, it is not necessary to machine the outside face of the element, but if it so to be secured to an arcuate metal plate, then machining is desirable.

A single arcuate element made as described above will extend across the full width of the carding roller with which the element co-operates. It is to be understood however, that two or more narrower elements could be produced (by the use of a narrower former) and fitted end-to-end on the mounting system of the machine.

Referring now to FIG. 4, there is shown a modification in the method of manufacturing arcuate card-clothed elements, in which fillet type card-clothing 30 is wound on to a former 32 in the same manner as described with reference to FIG. 1. Also timber stiffener sheets 34 are applied to the outside of the card-clothing and these are formed with saw-cuts 36 to allow the sheets to flex. However, the sheets are applied with the saw-cuts on the outside (see FIG. 3) so that the saw-cuts open up into Vee-shaped grooves. Resin is used to bind the timber sheets to the card-clothing and it is also poured into the grooves 36. When the resin sets, the timber stiffener becomes sufficiently rigid to maintain the shape of the arcuate element. It will be appreciated that the stiffener sheet 34 could be preformed by securing it to support blocks similar to the blocks 21 shown in FIG. 2.

Since the resin will probably produce an uneven surface on the outside of the stiffener 34, it is likely that the outside will have to be machined before the card-clothing is slit into sectors. In fact the resin may be applied over the entire outer surface of the stiffener and it must then be machined when it has set.

There are other materials which can be used to provide the card-clothing with the required rigidity, and one of these is shown in FIG. 5. A former 40 is wrapped with fillet type card-clothing 42 as described above with reference to FIG. 1. Woven glass fibre matting 44 is then applied all over the exterior surface of the foundation, and this matting is then impregnated with a resin and an activator for the resin, of the type which is used for a variety of purposes, where glass fibre reinforced plastics material is required to give a rigid structure.

The resin is allowed to set, and it should be mentioned, that the thickness of the layer of resin together with its reinforcing material is such, that when it has set, the card-clothing 42 bonded to it will be held in the cylindrical form in which it has been wound on the former 40, even after it is removed from the former.

It will be understood that metallic wire card-clothing could be used in place of flexible wire card-clothing, since the timber resin or plastics sustaining layer can be bonded on to the spines of the metallic wire in the same way that it is bonded to the undersurface of flexible foundation.

Again, if a resin sustaining layer requires reinforcing, that reinforcing need not be of glass fibre. For example, perforated metal sheets or even carbon fibre rods, could be incorporated in the plastics sustaining layer.

In an alternative method of manufacturing card-clothed arcuate elements of the kind previously referred to shown in FIG. 6 a former 50 is used which is only a segment or sector of a cylinder having approximately the same chordal length as that which is required in the finished card-clothed element. Consequently, the former is much smaller than the cylindrical formers previously described.

Card-clothing 52 of the flexible wire type in sheet form is used, and a piece is cut from the sheet and laid on the former with the teeth pointing inwardly. The cut sheet is of the correct size for the finished arcuate element, and there may be location lips or other locating devices on the former to position the card clothing. Once the card-clothing has been laid on the former, a timber stiffening member 54 and resin is applied as in the previously described method, and the resin is allowed to set to provide the sustaining layer holding the card-clothing in the required rigid form.

If the card-clothed element has to be secured to brackets, it can be removed from the former without further treatment, but if it is required to fasten it to a metal plate in the carding machine then it is preferably machined to the required part cylindrical shape whilst still on the former.

In another alternative method of carrying out the invention, the card-clothing is applied in sheet form to the convex surface of a part cylindrical segment 50 as described above, but instead of then applying a timber stiffener, a layer of resin is used as described with reference to FIG. 5.

It is to be understood that features from any one of the foregoing examples may be used in methods of manufacture according to the other examples.

One of the major advantages of the card-clothed element provided by the invention is that the user is able to change the card-clothed element without returning a plate assembly to the machine manufacturer. This is because the card-clothed elements themselves are self-sustaining in shape, and therefore the user can simply unbolt the worn element, and replace it with a fresh element taken from stock, or supplied by the machine manufacturer or card-clothing manufacturer.

Where a timber sheet is formed with saw-cuts which are subsequently filled with resin, this has the effect of relieving stresses in the timber and then stabilizing the timber sheet against distortion.

We claim:

1. A method of manufacturing an arcuate card-clothed element having carding teeth on its inner concave surface and adapted for operation in a textile machine comprising the steps of laying card-clothing on the convex surface of an arcuate former with the teeth of said card clothing projecting inwardly toward said former, providing an initially deformable sustaining element which is capable of being permeated by fluent bonding agent with an imparted shape including a concave surface substantially corresponding to the outside contour of the card clothing on the former and applying said sustaining element with said concave surface in backing relation to the card clothing on the former, and introducing a curable bonding agent for permanently bonding said sustaining element to the outside of said card-clothing while at the same time introducing some of the bonding agent to penetrate said sustaining element and curing said agent for stiffening the sustaining element while said card-clothing is on said former to fix the sustaining element to the card-clothing and maintain the shape of the card-clothing imparted by the former.

2. The method defined in claim 1, wherein at least some of said bonding agent is applied to penetrate the sustaining element prior to applying that element to the card clothing.

3. The method defined in claim 1, wherein said card clothing is wound in strips on a cylindrical former and after the sustaining element has been bonded thereto, the card clothing is severed axially of the former to provide a plurality of separate arcuate card clothing sectors.

4. The method defined in claim 1, wherein said sustaining element is a timber member made deformable by having a series of recesses cut through its concave surface, and said bonding agent is a curable liquid resin that penetrates said recesses.

5. The method defined in claim 1, wherein said card clothing is applied in sheet form to said arcuate former.

6. The method defined in claim 1, wherein said sustaining element is glass fibre.

* * * * *